US008677578B2

(12) United States Patent
Singh

(10) Patent No.: US 8,677,578 B2
(45) Date of Patent: Mar. 25, 2014

(54) DEVICE TO SECURE SHOELACE KNOT

(75) Inventor: Anurag Satyapal Singh, Tustin, CA (US)

(73) Assignee: Playantra LLC, Tustin, CA (US)

( * ) Notice: Subject to any disclaimer, the term of this patent is extended or adjusted under 35 U.S.C. 154(b) by 5 days.

(21) Appl. No.: 13/555,142

(22) Filed: Jul. 21, 2012

(65) Prior Publication Data

US 2014/0020219 A1 Jan. 23, 2014

(51) Int. Cl.
*A44C 7/00* (2006.01)

(52) U.S. Cl.
USPC ..... 24/712.5; 24/712.2; 24/712.6; 24/712.3

(58) Field of Classification Search
None
See application file for complete search history.

(56) References Cited

U.S. PATENT DOCUMENTS

| | | | | | |
|---|---|---|---|---|---|
| 1,190,724 | A | | 7/1916 | Chadwick | |
| 1,221,656 | A | | 4/1917 | Benson | |
| 1,531,410 | A | | 3/1925 | Osterholt | |
| 2,175,962 | A | * | 10/1939 | Kenifick | 24/128 |
| 2,305,552 | A | | 12/1942 | Nyhagen | |
| 2,650,399 | A | | 9/1953 | Torelli | |
| 3,677,250 | A | * | 7/1972 | Thomas | 604/180 |
| 4,047,651 | A | * | 9/1977 | McMullen | 224/168 |
| 4,290,172 | A | | 9/1981 | Burton | |
| 4,291,439 | A | | 9/1981 | Riti | |
| 4,327,512 | A | * | 5/1982 | Oliver | 40/636 |
| D270,779 | S | * | 10/1983 | Steinberg | D2/978 |
| 4,428,101 | A | * | 1/1984 | Harkavy | 24/712.4 |
| 4,553,293 | A | * | 11/1985 | Blum | 24/712.2 |
| 4,780,936 | A | * | 11/1988 | Brecher | 24/712.2 |
| 4,805,270 | A | * | 2/1989 | Kimbrough | 24/712.3 |
| 4,879,787 | A | * | 11/1989 | Walls | 24/712.2 |
| 4,949,437 | A | | 8/1990 | Anderson | |
| 4,999,888 | A | * | 3/1991 | Miller | 24/712.3 |
| 5,022,127 | A | | 6/1991 | Ang | |
| 5,158,428 | A | | 10/1992 | Gessner | |
| 5,170,573 | A | * | 12/1992 | Clinch | 36/50.1 |
| 5,195,981 | A | * | 3/1993 | Johnson | 604/180 |
| 5,208,950 | A | | 5/1993 | Merritt | |
| 5,459,947 | A | | 10/1995 | Lasher | |
| 5,572,778 | A | | 11/1996 | Stenner | |
| 5,704,933 | A | | 1/1998 | Fell | |
| 5,778,500 | A | * | 7/1998 | Illingworth | 24/712.3 |
| 5,913,483 | A | * | 6/1999 | Polk | 24/712.3 |
| 5,918,352 | A | * | 7/1999 | Galbreath | 24/712.3 |
| 5,924,177 | A | | 7/1999 | Jongejan | |
| 6,016,590 | A | | 1/2000 | Malone | |
| 6,247,214 | B1 | * | 6/2001 | Hyde | 24/712.6 |
| 6,546,649 | B1 | * | 4/2003 | Tobias | 36/112 |
| 6,588,078 | B2 | * | 7/2003 | Writt et al. | 24/712.2 |
| 6,663,600 | B2 | * | 12/2003 | Bierman et al. | 604/174 |
| 6,952,864 | B2 | * | 10/2005 | Moreno | 24/712.3 |
| 6,988,298 | B2 | * | 1/2006 | Ternasky et al. | 24/712.3 |

(Continued)

*Primary Examiner* — Jack W. Lavinder

(57) ABSTRACT

The device to secure the shoelace knot has flexible upper member and flexible lower member attached preferably using eyelet kind of part at equally spaced lateral apertures of upper member and lower member in a manner where upper member's top surface attaches to lower member's top surface so that shoelace can be inserted through apertures of upper member and a lower member to tie a knot over upper member's bottom surface. After tying regular shoelace bow knot over upper member's bottom surface, the upper member's body is folded at imaginary center axis to fasten the hook and loop ends while securing knot in bigger knot receiving aperture of upper member while lower member rests on shoe's surface providing extra support even when shoe is being used in regress sports activities and ensuring that knot remains tied.

6 Claims, 5 Drawing Sheets

(56) References Cited

U.S. PATENT DOCUMENTS

| | | | | |
|---|---|---|---|---|
| 7,018,362 | B2 * | 3/2006 | Bierman et al. | 604/174 |
| 7,044,508 | B2 * | 5/2006 | Burns et al. | 289/1.5 |
| 7,237,347 | B2 * | 7/2007 | Tobias | 36/112 |
| 7,320,161 | B2 * | 1/2008 | Taylor | 24/712.2 |
| 7,563,251 | B2 * | 7/2009 | Bierman et al. | 604/174 |
| 7,650,706 | B2 * | 1/2010 | Wartel et al. | 36/54 |
| 8,105,289 | B2 * | 1/2012 | Bierman et al. | 604/174 |
| D664,348 | S * | 7/2012 | Armstrong | D2/978 |
| 8,397,357 | B1 * | 3/2013 | Madey | 24/712.3 |
| 2006/0168850 | A1 * | 8/2006 | Wartel et al. | 36/136 |

* cited by examiner

DEVICE TO SECURE SHOELACE KNOT

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF INVENTION

The present invention relates to an improved knot securing device, that is a device that is used for locking bow knots in its place, and more particularly on shoes with shoelaces provided to act as closure means.

The problem of shoelace knot becoming untied is very common for the shoes containing laces, untied knots causes the shoelace ends to drag on the ground and causes damage to it or sometimes individual may get tripped due to such untied knot.

Many efforts have been made to provide devices or methods to secure the shoelace knots and prevent it from untying, though they have following limitations, a. They are made of rigid material such as plastic, metal etc.

b. They need mechanical parts such as springs or clamps to snap it to shoelaces and can damage soft shoelaces.

c. They cannot be used in regress sports activities such as soccer, running, hiking to name few.

d. They are not easy to use.

e. Manufacturing can be expensive and not feasible.

By way of example, U.S. Pat. No. 1,190,724 to Chadwick discloses a shoestring retainer, U.S. Pat. No. 1,221,656 to Benson discloses a shoe-lace clasp, U.S. Pat. No. 5,924,177 to Jongejan discloses a shoelace retention device, U.S. Pat. No. 6,938,308 to Funk discloses a lace securing and adjusting device.

Other attempts have been made to provide a device made of flexible material with hook and loop kind of fasteners but they have following limitations, a. They require fastening or gluing them to shoe's tongue.

b. They do not stay on shoe or shoelaces and can be misplaced easily.

c. Their fastening mechanism interferes with shoelace knot tying process.

d. Their fastening mechanism can damage the shoelaces.

e. Shoelace knot can still get loose during regress sports activities like running or hiking.

By way of example, U.S. Pat. No. 4,879,787 to Walls discloses a shoe lace knot securing device, U.S. Pat. No. 5,913,483 to Polk discloses a shoelace and tied knot securing apparatus, U.S. Pat. No. 6,016,590 to Malone discloses a lace wraps, U.S. Pat. No. 6,763,554 to Torrey discloses a self-engaging strap-form tie with special tab, U.S. Pat. No. 7,003,903 to Johnson discloses a pouch for concealing and containing shoelaces, U.S. Pat. No. 7,044,508 to Burns discloses a shoelace knot assisting device, U.S. Pat. No. 7,404,242 to Perler discloses a lace securing apparatus.

In this respect, the device of the present invention provides simple to use shoelace knot securing device that stays on shoelace without any gluing, keeps the knot secured even during regress sports activity such as running, hiking, soccer etc. and yet be cheaply manufactured and can be used with almost any kind of shoe that employs a lace as a closure device.

BRIEF SUMMARY OF THE INVENTION

The device to secure the shoelace knot has upper member and lower member attached preferably using eyelet kind of part at equally spaced lateral apertures in a manner where upper member's top surface attaches to lower member's top surface so that shoelace can be inserted through apertures of upper member and a lower member to tie a knot over upper member's bottom surface.

The lower member is made of flexible/resilient material and has a body with top surface and bottom surface. Lower member's body has two apertures positioned below the center imaginary axis of the body and laterally spaced in a manner so that shoelace can be inserted to tie the knot.

The upper member is made of flexible/resilient material and has a body with top surface and bottom surface. Upper member's body has two apertures positioned below the center imaginary axis of the body and laterally spaced in a manner so that shoelace can be inserted to tie the knot.

Upper member's body also has little bigger knot receiving aperture than eyelets receiving apertures in the middle just above the center imaginary axis.

Upper member's bottom surface has a hook and a loop kind of fasteners at its elongated ends perpendicular to body's center axis.

The device can be used with any shoe that employs a lace as a closure device.

Using the device, ends of shoelace are inserted through laterally spaced eyelet receiving apertures keeping the device in such a way that knot receiving aperture of upper member is towards the front of the shoe and lower member's bottom surface rests on the shoe. After tying regular shoelace bow knot over upper member's bottom surface, the upper member's body is folded at imaginary center axis to fasten the hook and loop ends while securing knot in bigger knot receiving aperture of upper member. Knot is being secured by upper member while lower member provides extra support by resting on shoe's surface to make sure knot remains tied while shoe is being used even in regress sports activities.

It is therefore a principal object of the present invention to provide a device for securing shoelace knot for any shoe that employs lace.

It is further object of the present invention to provide a device which does not require any adhesive to attach the device to a shoe.

It is also an object of the present invention to provide quality and economical solution to consumer with an ease of use to secure a knot to prevent any tripping may arise from untied shoelace.

It is an additional object of present invention to provide an easy to use device which stays on shoelace even after shoe is removed from the foot after the use.

DETAILED DESCRIPTION OF THE INVENTION

Figure 4:
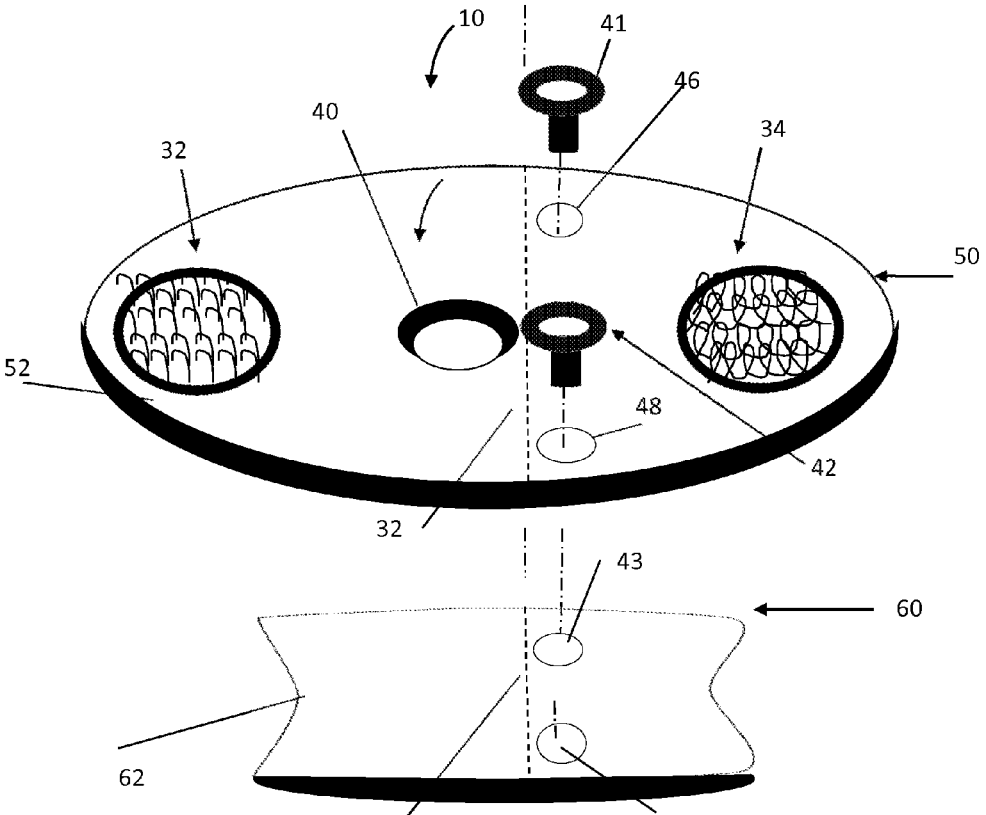
FIG. 4 is an exploded environmental view of a device according to present invention.
Figure 5A:
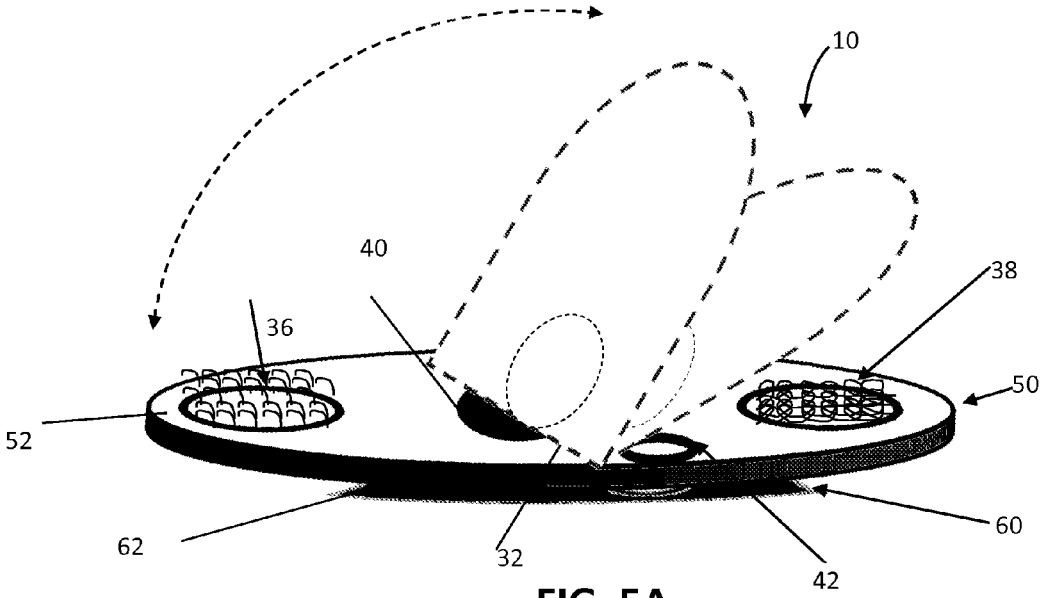
FIG. 5A is a perspective view of a device showing the upper member being folded at imaginary center axis for fastening its ends.
Figure 5B:
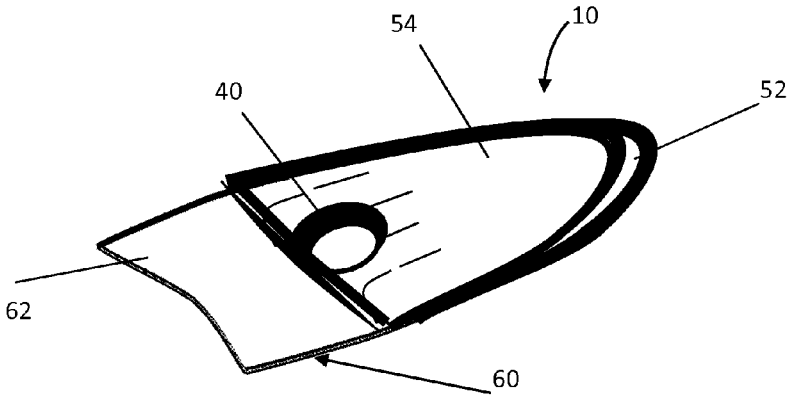
FIG. 5B is a perspective view of a device showing the upper member in folded at imaginary center axis.

The present invention is a device to secure the shoelace knot generally designated as 10 in the drawings. Referring first to FIG. 4 the device comprises of upper member 50 and lower member 60 aligned at imaginary center axis 32 of upper member 50 and imaginary center axis 34 of lower member 60 and attached preferably using eyelets 41 and 42 at equally spaced lateral apertures 46 and 48 of upper member and apertures 43 and 44 of lower member so that upper member 50's top surface 54 attaches to lower member 60's top surface 62.

Figure 1:
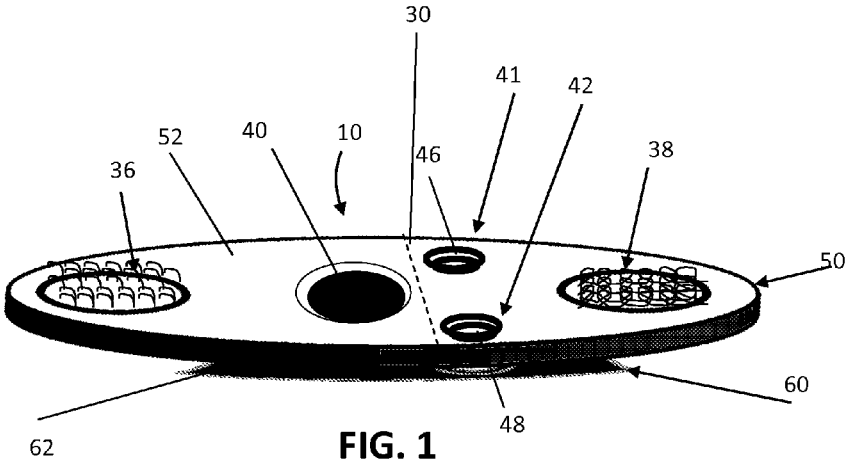
FIG. 1 is a perspective view of a device according to present invention.

As shown in FIG. 1, the device 10 after attaching upper member 50 to lower member 60 the center axis of device is 30 which is parallel to center axis 32 of upper member and 34 of lower member.

Figure 2A:
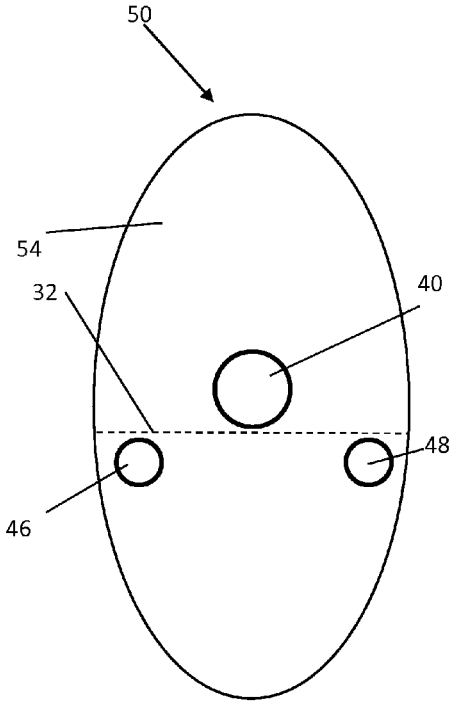
FIG. 2A is a top view of a upper member's top layer.

FIG. 2A shows upper member 50's top surface with imaginary center axis 32 going through the body of upper member 50, knot receiving aperture 40 located just above the center axis 32 and apertures 46 and 48 laterally arranged just below the center axis 32.

Figure 2B:
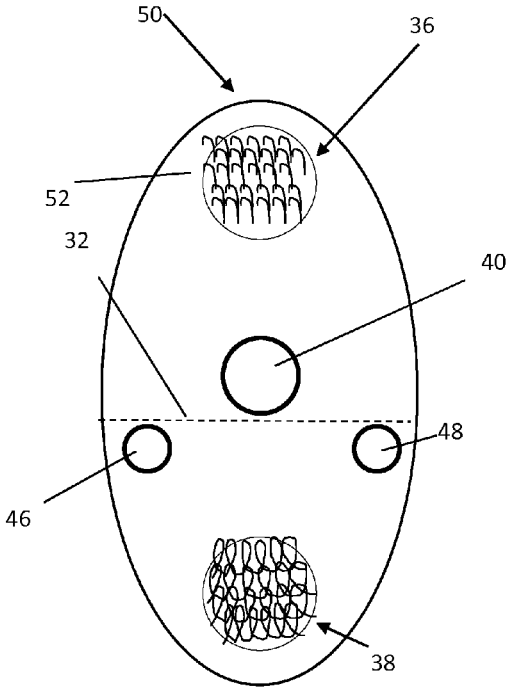
FIG. 2B is a top view of a upper member's bottom layer.

FIG. 2B shows upper member 50's bottom surface with imaginary center axis 32 going through the body of upper member 50, knot receiving aperture 40 located just above the center axis 32 and apertures 46 and 48 laterally arranged just below the center axis 32. Fastener's hook end 36 located at top elongated end while fastener's loop end 38 located at bottom elongated end perpendicular to imaginary center axis 32.

Figure 3A:
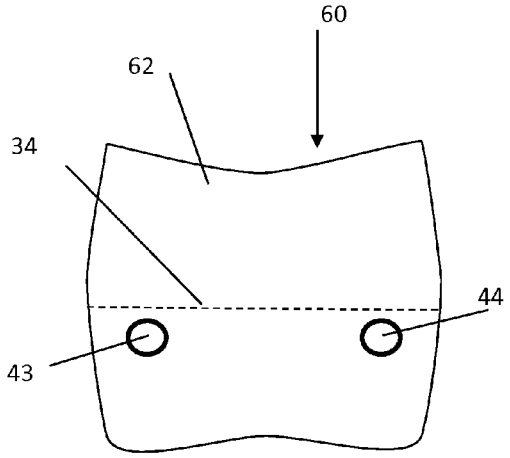
FIG. 3A is a top view of a lower member's top layer.

FIG. 3A shows lower member 60's top surface with imaginary center axis 34 going through the body of lower member 60 and apertures 43 and 44 laterally arranged just below the imaginary center axis 34.

Figure 3B:
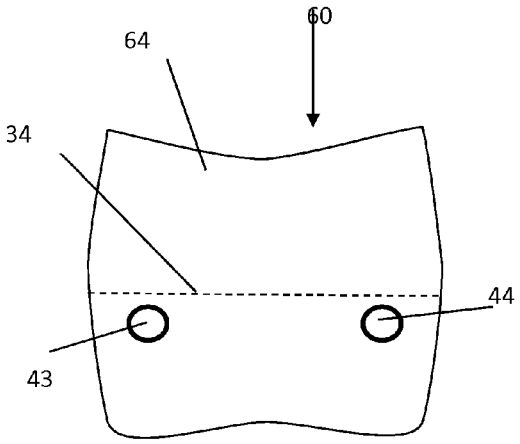
FIG. 3B is a top view of a lower member's bottom layer.

FIG. 3B shows lower member 60's bottom surface with imaginary center axis 34 going through the body of lower member 60.

Figure 6A:
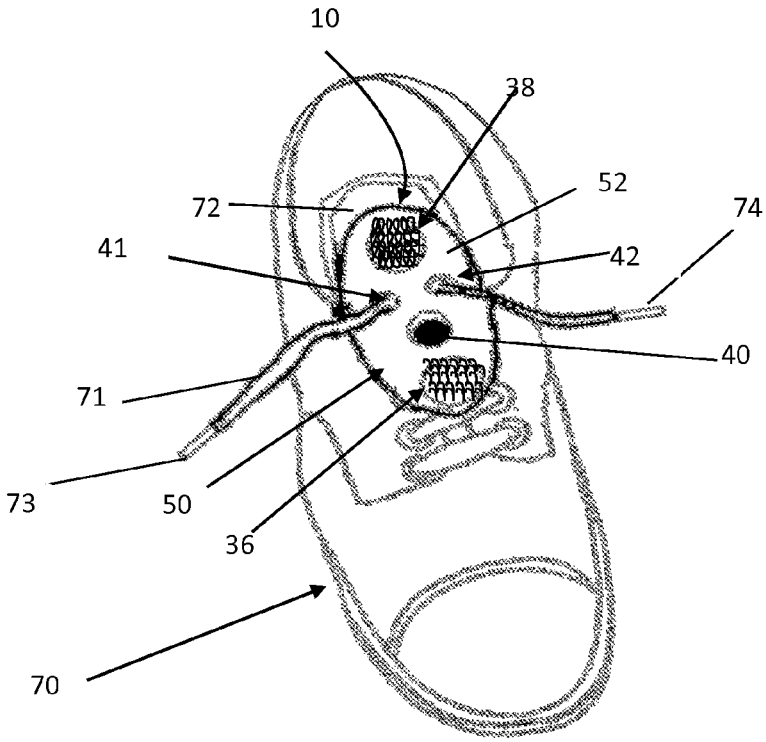
FIG. 6A is a perspective view of a device being inserted into shoelace.
Figure 6B:
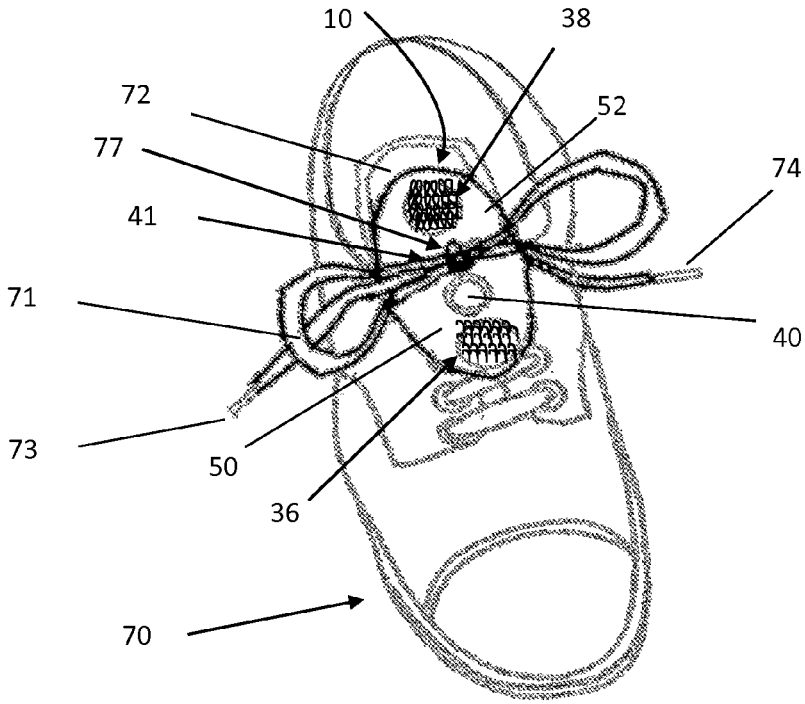
FIG. 6B is a perspective view of a device showing shoelace being tied after inserting the device.
Figure 6C:
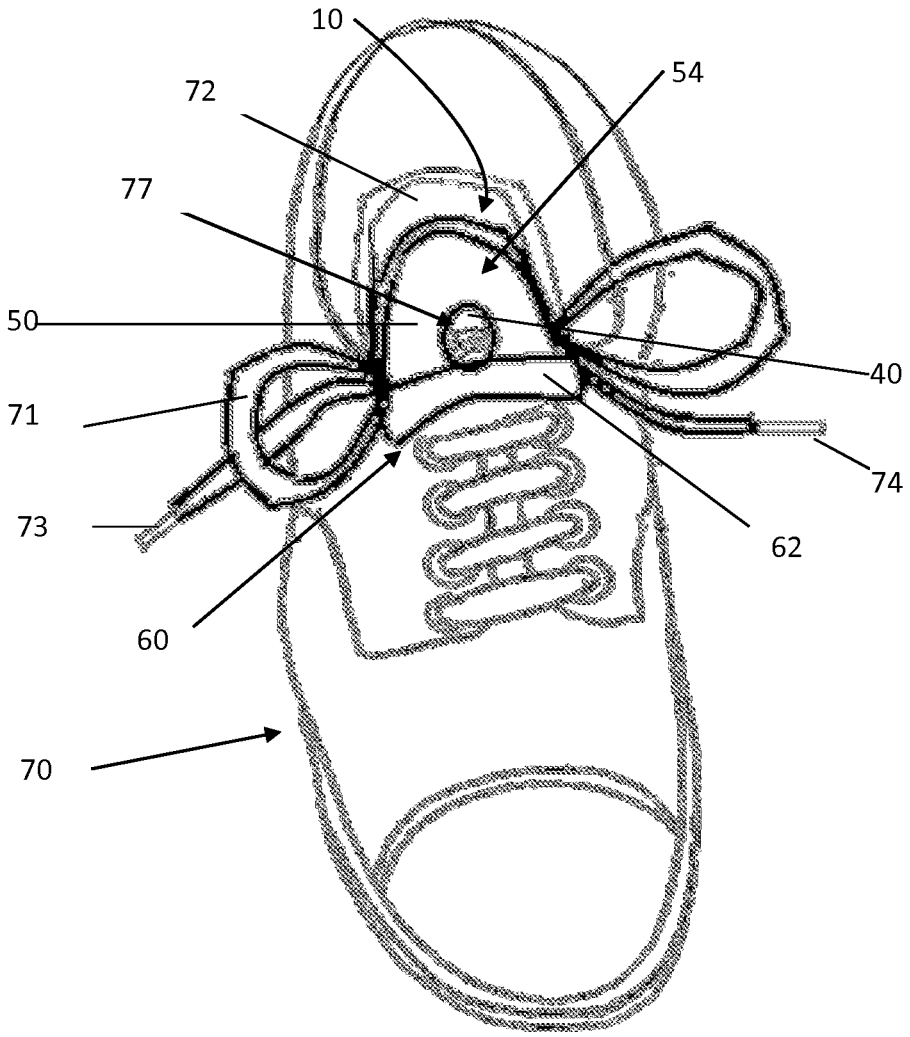
FIG. 6C is a perspective view of a device showing shoelace knot being secured after fastening the ends of upper member's bottom layer.

FIGS. 6A-6C show a device 10 in use with a shoe 70 to secure the shoelace knot 77. As shown in FIG. 6A, one of the shoelace 71's ends 73 is inserted from apertures 48 of upper member and 44 of lower member and shoelace end 74 is inserted from apertures 46 of upper member and 43 of lower member. Upper member 50's bottom surface 52 is facing up showing fastener's loop end 38 and hook end 36 and knot receiving aperture 40 is towards the front of the shoe 70. As shown in FIG. 6B that regular shoelace bow knot 77 is tied over just below the center axis 30 of device 10 thus device 10 is held in place on the shoe 70 by the shoelace bow knot 77. FIG. 6C shows the upper member is folded over knot to fasten hook and loop ends while knot 77 seating in the receiving aperture 40 of upper member 50 securing it in place and preventing knot 77 from being untied. The lower member 60 is providing support for the device 10 to keep it in place over a shoe 70.

This disclosure provides exemplary embodiments of the present invention. The scope of present invention is not limited by these exemplary embodiments. For instance, the hook 36 and loop 38 can be any fastening mechanism such as snap button, spring snap button etc. The device 10 can be of variety of shapes without departing from the spirit of the invention. Furthermore, the knot receiving aperture 40 could be any shape like circle, oval, triangle, rectangle etc. and not depart from the spirit of invention.

What is claimed is:

1. A device to secure shoelace knot and preventing it from getting untied, the device comprising:

a flexible upper member having a top layer and a bottom layer with at least two apertures positioned adjacent lateral opposite sides of said flexible upper member, respectively, and below a transverse axis located at the center of said flexible upper member to insert lace ends of the shoelace therethrough, a knot receiving aperture positioned just above said transverse axis, and said bottom layer having hook and loop fasteners, one of said hook and loop fasteners located at an end of said flexible upper member and the other of said hook and loop fasteners located at the opposed end of said flexible upper member; and a flexible lower member having a top layer and a bottom layer with at least two apertures positioned adjacent lateral opposite sides of said flexible lower member, respectively, and below a transverse axis located at the center of said flexible lower member to insert shoelace ends; wherein said flexible upper member transverse axis and said apertures are in alignment with and over said lower member transverse axis and said apertures with said flexible upper member being attached to said flexible lower member at said apertures.

2. The device of claim 1 wherein said knot receiving aperture is equally spaced from said opposed sides of said flexible upper member.

3. The device of claim 1 wherein said upper flexible member has a central longitudinal axis perpendicular to said transverse axis, said hook and loop fasteners being positioned on said central longitudinal axis at opposed ends of said upper flexible member.

4. The device of claim 1 wherein said device is secured to a shoelace knot by folding said upper flexible member upon itself to engage said hook and loop fasteners with one another while a shoelace knot is located between the folded portions of said upper flexible member.

5. The device of claim 1 wherein said top layer of said upper flexible member is adapted to display graphical material.

6. The device of claim 1 wherein said top layer of said lower flexible member is adapted to display graphical material.

* * * * *